United States Patent [19]

Langenhorst

[11] 4,424,607

[45] Jan. 10, 1984

[54] SYMMETRICAL DOOR HINGE

[75] Inventor: Günter Langenhorst, Bad Sassendorf, Fed. Rep. of Germany

[73] Assignee: top-element Bauelemente für Innenausbau + Raumgestaltung GmbH & Co. KG, Hamm, Fed. Rep. of Germany

[21] Appl. No.: 272,472

[22] Filed: Jun. 11, 1981

[30] Foreign Application Priority Data

Jun. 12, 1980 [DE] Fed. Rep. of Germany ... 8015568[U]

[51] Int. Cl.[3] ..... E05C 3/02; E05C 5/04

[52] U.S. Cl. ..... 16/387

[58] Field of Search ..... 16/387, 386

[56] References Cited

FOREIGN PATENT DOCUMENTS

| | | | |
|---|---|---|---|
| 167808 | 3/1955 | Australia | 16/387 |
| 28123 | 11/1906 | Austria | 16/387 |
| 42086 | of 0000 | Fed. Rep. of Germany | 16/387 |
| 303438 | 12/1932 | Italy | 16/387 |
| 490673 | 2/1954 | Italy | 16/387 |
| 512596 | 6/1957 | Italy | 16/387 |
| 632452 | 6/1962 | Italy | 16/387 |
| 296603 | 2/1952 | Switzerland | 16/387 |
| 1040862 | 9/1966 | United Kingdom | 16/387 |

*Primary Examiner*—Werner H. Schroeder
*Assistant Examiner*—Andrew M. Falik
*Attorney, Agent, or Firm*—Karl F. Ross; Herbert Dubno

[57] ABSTRACT

A hinge for a door comprises a pair of hinge members, one of which is affixed to the door frame while the other is attached to the door panel. The hinge elements are each formed with an attachment flange provided along an edge with a pivot sleeve which is in axial symmetrical alignment with the flange. The flange is formed with holes for the fastening screws and one of these holes at the center of the flange with the other holes being oriented in mirror symmetrical relationship so that the hinge element on the door can be rotated about the center provided by the central hole to assume positions for either left-handed or right-handed mounting. The pintle has a collar or shoulder between two plug-forming portions which fit into the sleeves of the two elements.

3 Claims, 4 Drawing Figures

SYMMETRICAL DOOR HINGE

FIELD OF THE INVENTION

My present invention relates to a hinge and, more particularly, to a door hinge for respective hinge elements pivotally interconnected by a pintle and secured respectively to a door panel and a door frame.

BACKGROUND OF THE INVENTION

While the hinge art is well developed and hinges can be found in a wide variety of shapes, sizes and mechanical interactions, the mounting of a door in a door frame by hinges frequently poses problems even to date.

In general, a door hinge can comprise a pair of hinge elements with interfitting eyes traversed by a pintle inserted from one side of the hinge and traversing the alternating eyes so as to pivotally interconnect the two elements.

The eyes are formed on mounting flanges with screw holes through which screws can be passed to engage the door or the door frame. These hinges can only be mounted in predetermined orientations with respect to the door or frame edges and frequently cannot be used if the hinge of the door is to be reversed, i.e. the hinges on the left-hand side of the door are to be transferred to the right-hand side or vice versa.

In general, the hinge systems must be constructed for either right-hand or left-hand use.

It has already been proposed to provide door frames, door panel and hinge arrangements for such door assemblies which can be utilized in a left-hand construction as well as a right-hand construction. Earlier systems in which the hinge was designed to accommodate either right-handed or left-handed mounting, have proved to be expensive and difficult to use to the point that the hanging of a door depending upon the direction in which the door was to swing, could be a relatively complex, expensive and time-consuming problem.

OBJECTS OF THE INVENTION

It is the principal object of the present invention to provide a hinge which eliminates the disadvantages of earlier hinge arrangements and enables a door to be hung in the door frame with a right-side or left-side mounting and change-over of the mounting without difficulty and without leaving a marred door edge.

Another object of this invention is to provide a door hinge which is comparatively simple, versatile and easy to use.

SUMMARY OF THE INVENTION

These objects and others which will become apparent hereinafter are attained in accordance with the present invention in a door hinge for a reversible door assembly whereby the hinge can mount a door in a door frame for either left-side or right-side hanging or which enables reversal of the side at which the door is hung.

According to the invention, the hinge comprises two pivotally interconnected hinge elements, each of which is formed with a fastening flange mounted upon the door frame and the door edge preferably by respective screws, these flanges having along edges thereof respective sleeves whose bores can be aligned to receive a common hinge pin or pintle.

According to the invention, these sleeves are axially symmetric and their ends coincident with the opposite edges of the respective flanges. Moreover, at least the flange of the element to be fixed to the door edge is formed with a central fastening bore (centrally disposed hole) with the remaining bores being disposed about the central bore in a mirror-symmetrical pattern.

The hinge pin or pintle engages in the aligned bores of the sleeves and has a central collar or shoulder from which plug-shaped sections of reduced cylindrical cross section extend to fit into the bores of the sleeves. These plug-type sections may be identical to one another.

The hinge element affixed to the door frame may also be provided with a central fastening bore with respect to which the other fastening bores are mirror symmetrically disposed.

Because of the axially symmetrical arrangement of the pivoted sleeves with respect to the mounting flanges of the hinge elements, the sleeves can always have the same position vis-à-vis the door whether the mounting is provided for a right-side or for a left-side construction.

Furthermore, the invention allows mounting or reversal of the door hinge for right-side or left-side use or vice versa, simply by loosening the center screw (and removal of the other mounting screws) and rotating the hinge about the center provided by the remaining center screw. The symmetry of the hinge assures proper positioning of the sleeve for either left-side or right-side use.

While the customary approach heretofore has been to entirely remove the hinge elements and reverse the positions thereof for right- and left-side mounting, respectively, the invention utilizes the fact that the door usually has similar surfaces on opposite sides so that the door hinge elements need not be changed over from one edge to an opposing edge but need merely be rotated to accomplish the effect of reversing the side from which the door is swingably suspended.

The door hinge element, after being rotated through 180°, can be secured in its new position by simply tightening the center screw and inserting the other mounting screws.

The hinge pin can then be inserted in the two sleeves of the elements forming each hinge.

The system of the invention has been found to be especially simple and readily adapted to right- or left-side door mounting, utilizing hinge elements which can all be identical, if desired. It should be noted that, while reference has been made herein to the rotation through 180° of the door-mounted hinge element, it is frequently possible to change the position of the door by rotating the frame-mounted hinge element in a similar manner.

It has been found to be advantageous, therefore, to provide each hinge element so that it is mirror symmetrical about a plane through the centrally disposed hole perpendicular to the plane of the flange and to the axis of the sleeve and to provide the sleeve so that it is mirror symmetrical with respect to a median plane along the sleeve axis perpendicular to the first-mentioned plane.

The bore in the sleeve can be throughgoing or a blind bore, i.e. closed at one end, and the collar may have an outer diameter corresponding substantially to the outer diameter of the sleeve. In all cases it is preferred that the ends of the sleeve lie flush with opposite edges of the flange, i.e. that each sleeve extend continuously along the edge of the flange at which the sleeve is provided and over the full length of this edge.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
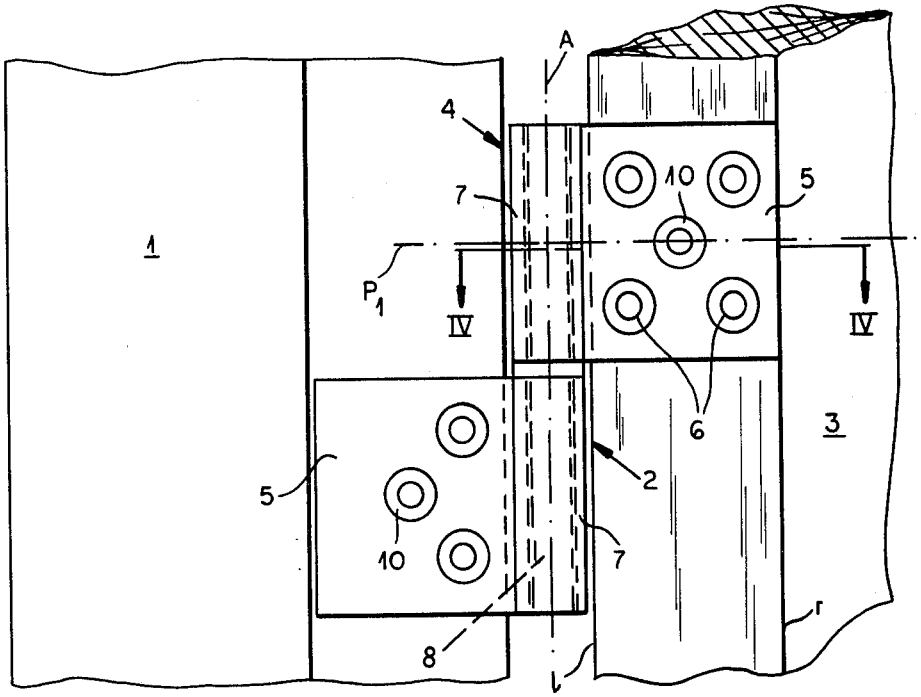
FIG. 1 shows an elevational view of a portion of a door frame and door panel provided with a hinge according to the invention.

In the drawing there is shown a door frame 1 or a portion thereof which is provided with one of the elements 2 of a hinge according to the invention, the other element 4 of which is mounted on an edge of a door panel 3. Each of the elements 2 and 4 is provided with a central fastening bore in a planar flange 5 thereof, the central bore (centrally disposed hole) being represented at 10 and being disposed such that its axis lies along a median plane $P_1$ forming a symmetry plane. The other fastening holes 6 are disposed mirror symmetrically on opposite sides of the plane $P_1$.

In the embodiment illustrated, the door-mounted hinge element 4 has five mounting holes including the centrally disposed mounting hole 10 while three mounting holes are provided for the hinge element 2. Either element, however, can have the three or five mounting hole array shown.

At one edge of each flange 5 there is provided a sleeve 7 having a throughgoing bore 9 adapted to receive the plug-shaped cylindrical ends 12 of a pintle or hinge pin 8 having a collar or shoulder 11 disposed centrally of this pin.

Figure 2:
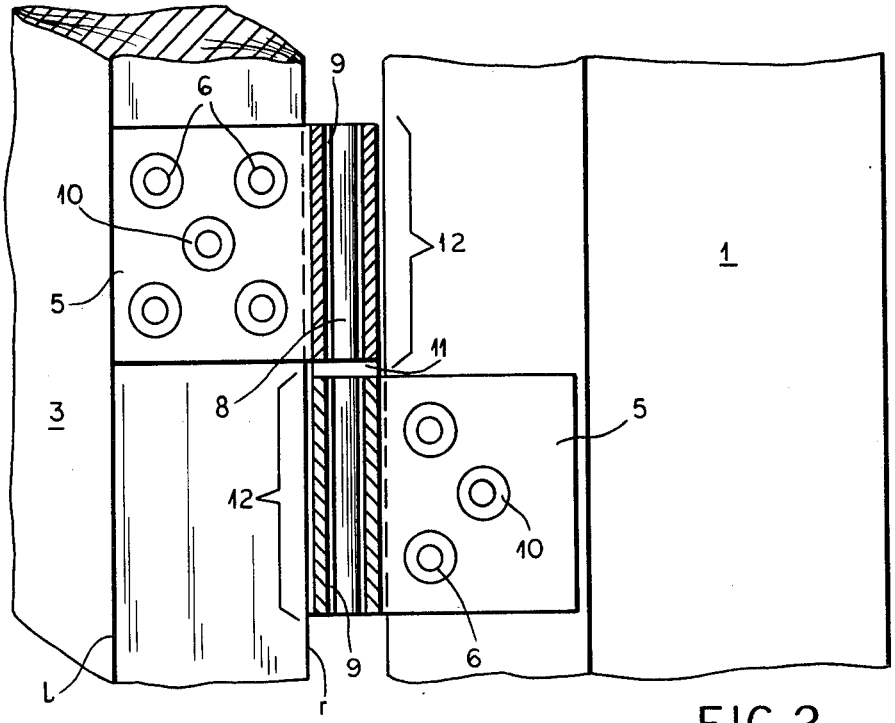
FIG. 2 is a view showing a reverse mounting of the hinge of FIG. 1 with the sleeves of the hinge elements represented in axial section.

The sleeve 7 is disposed mirror symmetrically with respect to a plane $P_2$ (FIG. 2) perpendicular to the plane $P_1$ and containing the axis A of the sleeve.

Figure 3:
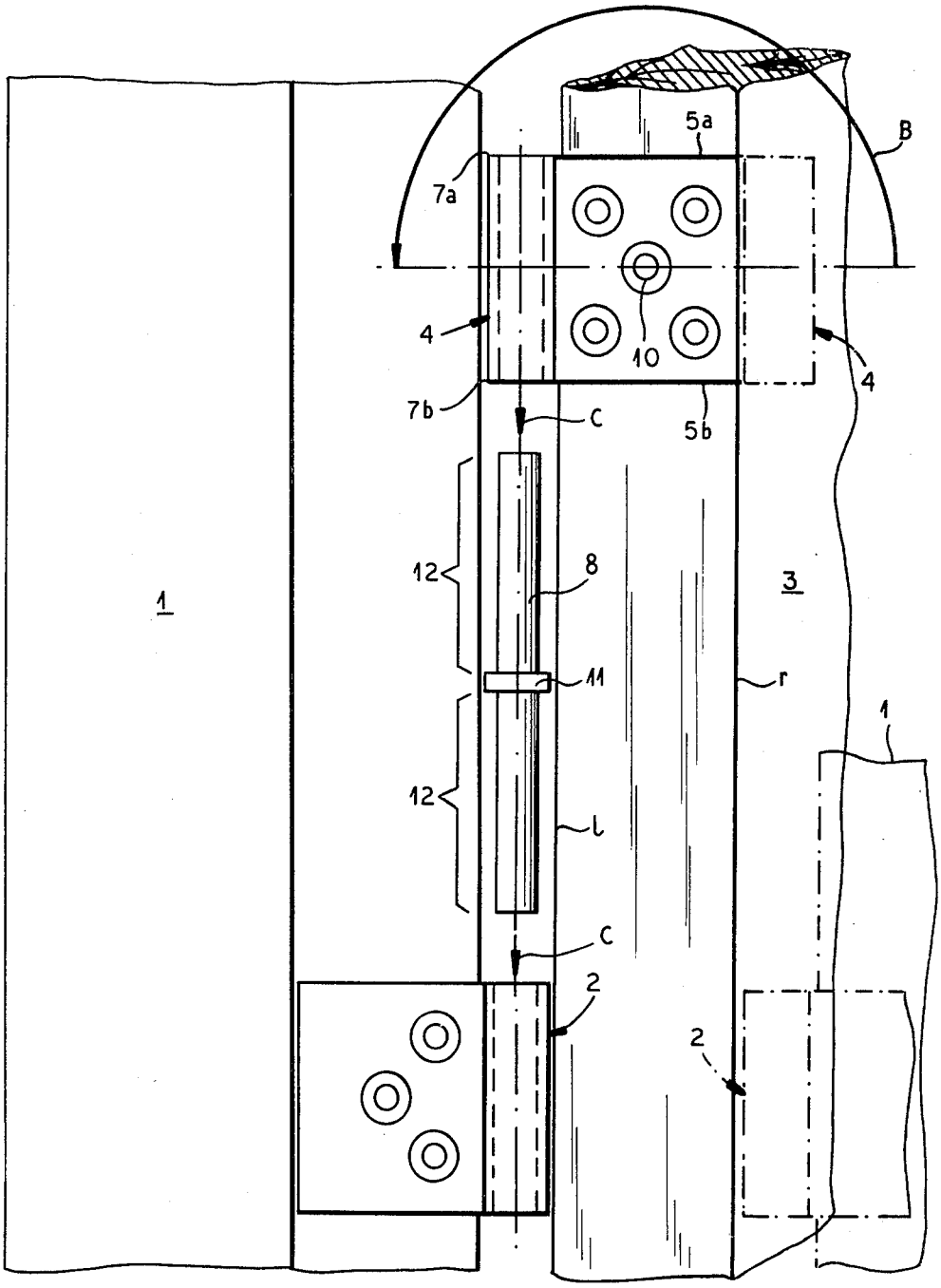
FIG. 3 is a diagrammatic illustration in an exploded view, showing the operation of the hinge according to the invention.
Figure 4:
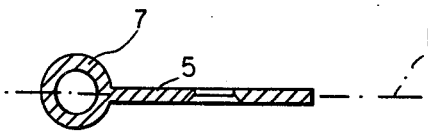
FIG. 4 is a section through one hinge element taken along the line IV—IV of FIG. 1.

As can be seen from FIG. 3, the opposite ends 7*a* and 7*b* of the sleeve 7 lie flush with opposite edges 5*a* and 5*b* of the flange 5.

The result of this symmetrical arrangement is that the centrally disposed hole 10 can receive a screw forming a pivot enabling rotation of, for example, the door-mounted hinge element through 180° as represented by the arrow B from a position in which the sleeve lies along the right-hand side r (dot-dash lines in FIG. 3) to a position in which this element lies along the left-hand side 1 of the door. The hinge can then be assembled as shown by the arrows C in FIG. 3 to form the hinge arrangement illustrated in FIG. 1. In the other position of the door mounted element, the hinge can be assembled as shown by the dot-dash lines in FIG. 3 to provide the hinge arrangement shown in FIG. 2.

While the ends 12 of the hinge pin have been shown to be equal in length to the sleeves, and to one another, such identity is not necessary and frequently it is desirable to make one of these ends longer than the other. All of the mounting holes 6, 10 can be countersunk to receive the heads of standard wood screws.

I claim:

1. A door hinge comprising a pair of identical hinge elements adapted to be mounted respectively upon a door frame and a door, each of said elements having a flat flange provided on one edge over the full length thereof with a sleeve in axial symmetric orientation with said flange whereby a median plane at said flange is a diametral plane of the sleeve, each sleeve being open at its opposite ends and of uniform cross section over its entire length, each of said flanges being provided with a plurality of screw-receiving holes; and a hinge pin formed with a collar at an intermediate location along its length and respective identical cylindrical ends each extending over said full length and interchangeably received in said sleeves from opposite ends to swingably interconnect said elements, both of said elements having centrally disposed screw-receiving holes in the respective flanges and all of the mounting holes of each flange being disposed mirror symmetrically about respective planes perpendicular to the axis of the respective sleeve whereby said elements can each be rotated about the axis of the respective centrally disposed hole for opposite side hinging of a door.

2. The hinge defined in claim 1 wherein one of said elements has five mounting holes in the respective flange.

3. The hinge defined in claim 1 wherein one of said elements has three mounting holes in the respective flange.

* * * * *